US007458329B2

(12) United States Patent
Nedwed

(10) Patent No.: US 7,458,329 B2
(45) Date of Patent: Dec. 2, 2008

(54) HYDROGYRO SHIP STABILIZER AND METHOD FOR STABILIZING A VESSEL

(75) Inventor: Timothy J. Nedwed, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 334 days.

(21) Appl. No.: 10/589,277

(22) PCT Filed: Mar. 8, 2005

(86) PCT No.: PCT/US2005/007464

§ 371 (c)(1),
(2), (4) Date: Aug. 10, 2006

(87) PCT Pub. No.: WO2006/022847

PCT Pub. Date: Mar. 2, 2006

(65) Prior Publication Data

US 2007/0272142 A1 Nov. 29, 2007

Related U.S. Application Data

(60) Provisional application No. 60/556,398, filed on Mar. 25, 2004.

(51) Int. Cl.
*B63B 39/00* (2006.01)

(52) U.S. Cl. ..... 114/122

(58) Field of Classification Search ..... 114/122
See application file for complete search history.

(56) References Cited

U.S. PATENT DOCUMENTS 769,493 A * 9/1904 Schlick ..... 74/5.22
1,150,311 A 8/1915 Sperry
2,104,226 A 1/1938 Gonzales ..... 74/5

(Continued)

FOREIGN PATENT DOCUMENTS

DE 11 01 205 B 3/1961

(Continued)

OTHER PUBLICATIONS

Allensworth, T. (1999) "A Short History of Sperry Marine", *Litton Marine Systems*, website, 5 pgs.

(Continued)

*Primary Examiner*—Jesús D Sotelo

(57) ABSTRACT

An apparatus for stabilizing a vessel is provided. The apparatus, or "hydrogyroscope," includes a liquid container disposed along the hull of a floating vessel. The liquid container provides a rotational flow path therein for a spinning liquid mass. The liquid container also preferably includes a valve for receiving water or other liquid into the rotational flow path of the container. The liquid is preferably supplied from the marine environment in which the vessel operates. In one embodiment, a motor is provided for rotating the liquid container, causing the water to rotate along the rotational flow path within the container and relative to the hull of the vessel. A method is also provided for stabilizing the vessel. The method in one embodiment includes the steps of moving the vessel to a desired location within a marine body, filling the liquid container of the vessel stabilizing apparatus, and actuating a motor that causes liquid to flow along the rotational flow path of the liquid container.

34 Claims, 6 Drawing Sheets

U.S. PATENT DOCUMENTS

| | | | | |
|---|---|---|---|---|
| 2,949,784 | A | 8/1960 | Maeder | 74/5.7 |
| 2,953,925 | A | 9/1960 | Yeadon | 74/5.7 |
| 3,060,751 | A | 10/1962 | Stoddard | 74/5 |
| 3,389,674 | A | 6/1968 | Pratt | 114/122 |
| 3,516,280 | A | 6/1970 | Vandrey et al. | 74/5.7 |
| 3,568,620 | A | 3/1971 | Douglas | 114/125 |
| 3,574,485 | A | 4/1971 | Herman, Jr. | 417/50 |
| 3,643,617 | A | 2/1972 | Holden | 114/126 |
| 3,727,573 | A | 4/1973 | Prohaska | 114/122 |
| 3,862,732 | A | 1/1975 | Wyatt et al. | 244/165 |
| 4,504,033 | A | 3/1985 | Engelking | 244/170 |
| 5,628,267 | A | 5/1997 | Hoshio et al. | 114/122 |
| 5,839,386 | A | 11/1998 | Frieling et al. | 114/121 |
| D404,438 | S | 1/1999 | Hunts | D21/460 |
| 6,360,838 | B1 | 3/2002 | Kulhavy | 180/219 |
| 6,561,856 | B1 | 5/2003 | Gorshkov | 440/9 |

FOREIGN PATENT DOCUMENTS

| | | |
|---|---|---|
| FR | 2 220 416 | 10/1974 |
| JP | 54124494 | 9/1979 |
| SU | 1601022 | 12/1988 |
| WO | WO 99/30965 | 6/1999 |

OTHER PUBLICATIONS

Lewis, J. et al. (2002) "Balancing Act: an exclusive look at the engineering behind the Segway HT, with some never-before-published technical details," *Design News*, v. 57, No. 6, p. 52(5).

Karwacki, F. A. (1992) *Encyclopedia of Science & Technology*, v. 8, 7th Ed., McGraw-Hill, pp. 75-79.

Oplinger, K.. A. (1948) "Gyroscopes and Their Applications" *Westinghouse Engineer*, v. 8, May 1948, pp. 75-79.

Sims, A. J. (1952) "The Rolling of Ships" *Shipbuilding and Shipping Record*, pp. 631-633.

Webster, A. G. (1947) *Partial Differential Equations of Mathematical Physics*, Paperback Ed., Chapter X, pp. 166-192.

(1947) *The Engineering Index*, pp. 531, 1059-1060.

(1948) *The Engineering Index*, pp. 573.

(1951) *The Engineering Index*, pp. 99.

(1952) *The Engineering Index*, pp. 944.

(1953) The Engineering Index, pp. 476.

(1955) The Engineering Index, pp. 465, 958.

(2003) Titles List from Search of the Library of Congress Online Catalog, 8 pgs.

(2004) European Standard Search Report No. RS 111307US, 5 pgs.

* cited by examiner

HYDROGYRO SHIP STABILIZER AND METHOD FOR STABILIZING A VESSEL

CROSS REFERENCE TO RELATED APPLICATIONS

This application claims the benefit of U.S. Provisional Application 60/556,398, filed Mar. 25, 2004.

BACKGROUND

1. Field of Inventions

Embodiments of the present invention generally relate to a marine craft. Preferred embodiments relate to the stabilization of marine craft by minimizing rolling and/or pitching motion. Further still, embodiments relate to the use of a spinning liquid mass in order to minimize oscillation in a marine vessel.

2. Description of Related Art

A gyroscope mounted with its single gimbal axis orthogonal to the major axis of a ship serves to limit rolling motion. Further, a gyroscope mounted with the gimbal axis parallel to the major axis of the ship reduces pitching motion. The gyroscope uses angular momentum and precession to counter these oscillations. Larger vessels require a larger gyroscopic system that can provide greater stabilization forces, while smaller vessels may employ a smaller gyroscopic system.

The utility of gyroscopes as a means of stabilizing watercraft has been known for many years. Stabilization increases passenger comfort and safety, reduces wear and tear on equipment, and increases the accuracy of warship artillery. An early gyroscope patent is U.S. Pat. No. 1,150,311, which issued in 1915 to inventor Elmer A. Sperry. The '311 patent was entitled "Ship's Gyroscope." Mr. Sperry's gyroscope employed a large, solid spinning mass that precessed about gimbal bearings. The gimbal bearings were connected to a frame. The frame, in turn, was operatively connected to the hull of a ship.

Mr. Sperry's gyroscope was utilized by the U.S. Navy as an early gyro-stabilizer system. According to one publication, the gyro was installed aboard a small 700 ton destroyer, and in a submarine. Using the centrifugal motion of the spinning mass, gyrsoscopic forces were transmitted to the hull of the naval vessels through the gimbal axis. Depending upon the orientation of the gimbal axis, the gyroscopic forces could stabilize a floating vessel either as to pitch or as to roll.

Mr. Sperry's gyroscope was "active" in operation, rather than "passive." In this respect, the Sperry gyroscope used a small gyroscope that sensed the onset of rolling motion. This small gyroscope was electrically connected to the switch of a motor that actuated a precessional gear mounted on a much larger gyroscope. A small gyroscope is more sensitive to rolling motion at inception than a large gyroscope. By activating the motor connected to the precessional gear of the large gyroscope, the large gyroscope was forced to precess at the moment it was needed. Further the motor can increase or decrease the angular velocity of precession to increase or decrease the stabilizing torque as needed based on the magnitude of the external torque. This "active" gyroscope system is preferable in many cases to a "passive" system because the rotor on an "active" gyroscope can be smaller.

Stabilizing torque of a gyroscope is a function of several factors. These include mass of the flywheel, or "rotor," angular velocity of the rotor, radius of the rotor, and angular velocity of precession of the rotor when subject to an external torque. In order to provide stabilization for a large vessel such as a war ship, Mr. Sperry's ship gyroscope was required to utilize a large metal rotor having a great deal of mass. According to one publication, Mr. Sperry's gyroscope as utilized by the U.S. Navy weighed 5 tons.

The manufacture of such a device was and remains understandably expensive. In addition, the added weight of the gyroscope increases the fuel consumption of the vessel when in transit. As a result, technologies such as the "active fin" system were developed after World War I to utilize gyroscopic forces in a more indirect manner, permitting the use of smaller gyroscopes. The fin method was preferred to Sperry's ship gyroscope in part due to the much lower weight requirement. Additional background can be found in U.S. Pat. No. 3,389,674 to Pratt, U.S. Pat. No. 2,104,226 to Gonzales, DE 11 01 205 to Salomon, SU 1,601,022 to Moscovskii Avtomobilno Dorozhnyj Institute as reported in Derwents, U.S. Pat. No. 2,953,925 to Yeadon, FR 2 220 416 to Alsthom and JP 54 124494 to Ishikawajima Harima Heavy Ind. Co. Ltd. as reported in Patent Abstracts of Japan.

The use of active fins to reduce roll continues today. The active fin system works using a small gyroscope that senses rolling motion and sends a signal to move hull-mounted external fins that counter the motion. However, the active fin system requires that the ship be moving. The active fins are of no value in eliminating oscillations of marine vessels that are at rest. In order to eliminate oscillations of a ship at rest, one or more larger gyroscopes operatively connected to the ship's hull would have to be reintroduced. This has generally proved to be impractical and/or cost-prohibitive.

An important activity that requires stabilization of marine vessels that are at rest is the extraction and transport of hydrocarbons. A few examples of such vessels are membrane liquefied natural gas (LNG) tankers, offshore workboats, drill ships, floating production storage and offloading vessels (FPSO's), catenary anchor leg mooring buoys ("CALM" buoys), and oceanographic survey vessels.

Membrane LNG tankers cannot be loaded or offloaded in certain sea states, as excessive roll and pitch motion creates sloshing of liquid within the tanker. Excessive sloshing of large volumes of LNG can cause damage to the containment tanks. Because of this, LNG tankers must postpone loading or offloading when certain heavy seas are forecast. Therefore, a method to stabilize LNG tankers during loading or offloading would increase the integrity of these vessels and reduce vessel standby time.

Offshore oil and gas platforms need frequent resupply from land. This resupply is performed using workboats that tie up to the platform while a crane is used to transfer supplies to the platform. The transfer becomes increasingly difficult and hazardous as seas become rough. Thus, stabilization of the workboat is desired.

Drill ships oftentimes operate in rough seas. Weather and marine forces act against drill ships to reduce their operability. A particularly difficult operation in rough seas is the movement of large stands of vertical pipe into and out of a borehole. In addition, while drilling proceeds the drill pipe travels from the drilling rig down to the seafloor inside a riser pipe. Excessive rolling motion of the ship can cause the drill pipe to contact the riser pipe. This contact, and extreme motion in general, increases the risk of failure of the riser and equipment stress/fatigue in general. Thus, stabilization of drill ships will increase their operability and integrity.

Floating production storage and offloading vessels (FPSO's) typically remain moored for long periods of time. The natural oscillatory motion applied by the ocean to these vessels increases the rate of fatigue of mooring lines and other equipment. Also, large motions can decrease the efficiency of certain oil-water separation equipment that require quiescent conditions. A large vessel stabilizing gyroscope installed on an FPSO would decrease equipment fatigue and increase oil-water separation efficiency.

Mooring line fatigue is also an issue with buoys, such as catenary anchor leg mooring buoys, known as "CALM" buoys. Thus, stabilization of CALM buoys is desired.

Oceanographic survey vessels require stability during certain critical measurements. Likewise, seismic vessels need stability during operations.

Stabilization is also desirable in rescue craft and pleasure boats. Placement of an appropriately-sized gyroscope would aid in providing treatment and comfort to a rescued worker, and would minimize debilitating sea sickness of all passengers. However the placement of solid mass gyroscopes in smaller vessels is not always practical.

High-speed boat racing is a particularly hazardous activity. It is not uncommon for these boats to lose control and become airborne. This result occurs when control of the attitude of the boat is lost in choppy water. Those of ordinary skill in the art will appreciate that "attitude" refers to the orientation of a craft relative to the direction of its motion. A gyroscope mounted along the hull of a racing boat would act to maintain the attitude of a racing boat while the boat is in motion. It would do this by countering the forces that would act to change the boat's attitude at inception when these forces are still weak. Thus, an appropriately designed gyroscope could increase the integrity of high-speed racing boats.

Therefore, there is a need for a gyroscopic system that can provide stabilization of marine vessels even while the vessel is not being propelled. Further, there is a need for such a system that is relatively lightweight during manufacture and installation. Still further, there is a need for such a system that utilizes abundantly available seawater as the spinning mass during operation. Finally, there is a need for such a system that is capable of offloading the seawater when the vessel is moving, thereby minimizing fuel usage.

SUMMARY

The present disclosure provides embodiments of a vessel stabilizing apparatus. The vessel stabilizing apparatus operates as a "hydrogyroscope." In this respect, the apparatus includes a liquid container secured along the hull of a floating vessel. The liquid container has a flow path therein for liquid. The liquid flow along the flow path serves as the rotor for the gyroscope.

A means is provided for inducing rotational movement of the liquid. The rotational motion of the liquid induces gyroscopic stabilization of the vessel. In certain embodiments, a valve is provided along the liquid container for receiving liquid into the rotational flow path of the container. The valve serves as a through-opening for liquid into the container, allowing the operator to optionally fill the liquid container with water from the marine environment after the floating vessel has been located at a desired position in the water. Where the marine environment is an ocean body, the operator may take advantage of the abundantly available seawater for filling and emptying the liquid container.

The means for inducing rotational flow of the liquid within the liquid container may take different forms. In one embodiment, the means is a mechanical motor having a drive shaft. The drive shaft is operatively connected to the liquid container at a first end. In this manner, the liquid container and the liquid therein may be rotated at a high speed. Friction between the inner diameter of the liquid container and the liquid itself induces and maintains rotational motion of the liquid. Alternatively, the means for inducing rotational flow of the liquid within the liquid container may be a hydraulic motor, or pump. The pump operates to continuously circulate liquid within the liquid container in an angular flow path. Each device serves as an alternative form of a "movement device" for imparting movement to a fluid within the liquid container.

Opposing frame support members securable to the hull of a floating vessel are provided to support the liquid container. The frame members provide bearing connections with the liquid container, forming a gimbal axis about which the liquid container may precess. If the operator desires to stabilize the vessel as to roll, the frame support members are secured to the hull of the vessel at an orientation that is orthogonal to the length (or major axis) of the vessel. If the operator desires to stabilize the vessel as to pitch, the frame support members are secured to the hull of the vessel at an orientation that is parallel to the major axis of the vessel. Optionally, the operator may employ a pair of hydrogyroscopes so that the vessel may be simultaneously stabilized as to roll and pitch.

The liquid container of the vessel stabilizing apparatus may take various shapes. In one embodiment, the liquid container has a rotational axis and is rotated by a motor and connected shaft. The container is connected at a point along its rotational axis to a gimbal frame. The gimbal frame includes gimbal connections secured between first and second frame support members. The frame support members, in turn, are secured to the hull of the vessel.

In another embodiment, the liquid container is a circular tube, or "annular ring." Liquid within the container is rotated by use of one or more pumps. In this embodiment, the liquid container itself need not rotate. The annular ring liquid container is secured by gimbal connections between first and second frame support members. The frame support members, in turn, are secured to the hull of the vessel. The opposing frame support members provide bearing connections with the liquid container, forming a gimbal axis about which the liquid container may precess.

In addition, the hydrogyroscope can be operated as an "active" system. The "active" system employs a hydrogyroscope as described above, in conjunction with a gear system mounted on the gimbal axis of the hydrogyroscope. The gear system may include a first gear for moving the hydrogyroscope about the gimbal axis, and a second gear for turning the first gear. A precessional motor is mounted to one of the support frames for moving the first gear. In addition, a small gyroscope may be mounted on the pitch or roll axis of the vessel, and a feedback control system provided that allows the small gyroscope to activate the precessional motor to force precession of the large hydrogyroscope when rolling and/or pitching motion is detected.

A floating vessel is also provided. The floating vessel includes a hull. The floating vessel also includes a vessel stabilizing apparatus as described above in various embodiments.

In addition, a method for stabilizing a floating vessel is provided. In one embodiment, a liquid container is provided along the hull of a floating vessel. The liquid container may be as described above, and receives liquid therein. The liquid container is secured to the hull of the floating vessel through a gimbal frame and axis, and then through opposing frame support members. The floating vessel is moved to a desired location in a marine body, such as the ocean. The liquid container is filled with liquid such as sea water. In one aspect, this occurs after the vessel has been moved to the desired location and moored. A motor is provided to actuate rotational movement of the liquid within the liquid container. The motor may be a mechanical motor as described above, causing rotational movement of the liquid container relative to the hull of the floating vessel. Alternatively, the motor may be a hydraulic motor, or pump, that circulates liquid within the liquid container. Also, the hydrogyroscope can be a "passive" system wherein it precesses after encountering torque applied from rolling or pitching motion, or it can be an "active" system wherein a mechanism is provided to force the hydrogyroscope to precess.

The hydrogyroscope and methods provided herein have utility in connection with numerous types of vessels. These include, but are not limited to, pleasure boats, offshore rescue craft, seismic vessels, tankers (such as a membrane-type LNG tanker), offshore workboats (including a drillship), buoys (such as a CALM buoy), a SPAR and oceanographic survey vessels.

DETAILED DESCRIPTION OF THE PREFERRED EMBODIMENT

Definitions

Figure 1:
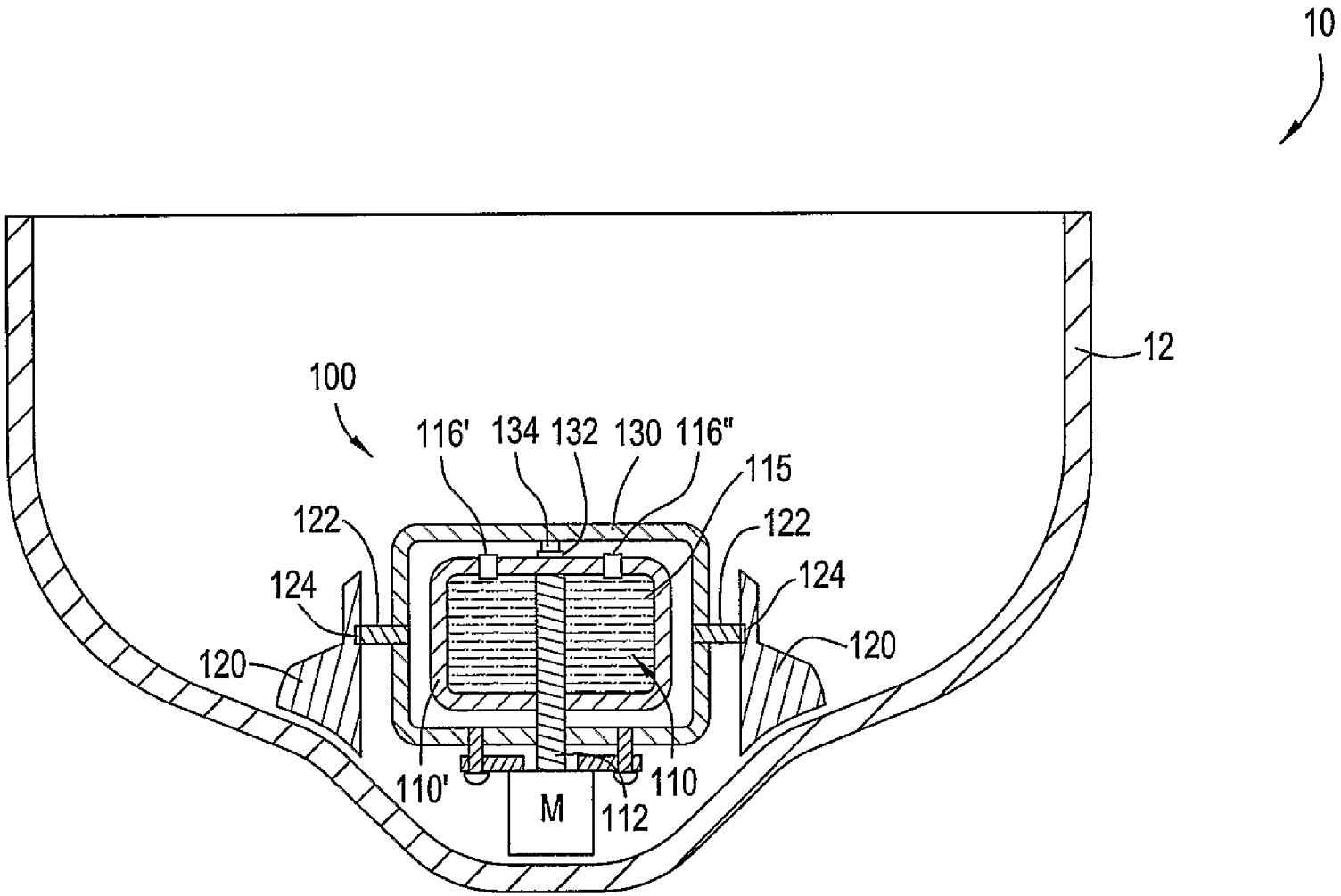
FIG. 1 presents a cross-sectional front view of the hull of a vessel. The vessel in FIG. 1 is a ship-shaped vessel. A "hydrogyro" vessel stabilizing apparatus, in one embodiment, is presented within the ship's hull. This embodiment depicts a "passive" configuration."

The following words and phrases are specifically defined for purposes of the descriptions and claims herein. To the extent a claim term has not been defined, it should be given its broadest definition that persons in the pertinent art have given that term as reflected in printed publications, dictionaries and issued patents.

"Hydrogyroscope" means a gyroscope that operates through the use of a spinning liquid mass, and that includes a liquid container preferably having a valve.

"Valve" means any through-opening provided for receiving liquid into the liquid container, or removing liquid from the container. Non-limiting examples of through-openings include a threaded connector, a quick-connect connector, or other connector for connecting a hose to the through-opening. The valve may have a flapper member, membrane or plate biased to seal the through-opening.

"Chamber" means any cavity, bladder or opening within a liquid container.

"Rotational flow path" means any rotational motion of liquid either by the action of a rotating chamber or along an inner diameter of a stationary chamber.

"Liquid" means any liquid. "Ambient water" means water taken from the marine environment in which a floating vessel is located. An example is seawater from an ocean body. Another example is fresh water taken from a large lake.

"Motor" means any type of motor, including a mechanical motor such as one that rotates a drive shaft, or a hydraulic pump that pumps liquid.

"Inner diameter" means an inner surface of a container wall, regardless of profile.

"Movement device" means a device that imparts movement to a fluid. Non-limiting examples of a movement device include a pump and a mechanical shaft driven by a motor.

Description of Specific Embodiments

A description of certain embodiments of the inventions is presented below.

In one embodiment, a vessel stabilizing apparatus is provided. The apparatus comprises a liquid container securable to a floating vessel; means for urging the liquid to spin within the liquid container relative to the floating vessel in order to stabilize the floating vessel within a marine body; and opposing frame support members securable to the hull of a floating vessel, the frame members providing bearing connections with the liquid container forming a gimbal axis about which the liquid container may precess. The vessel stabilizing apparatus may further comprise a gimbal frame for supporting the liquid container, with the gimbal frame having at least one connector connected to the liquid container along an axis of rotation of the liquid container; and wherein the bearing connections of the opposing frame support members are connected to the gimbal frame so that the gimbal frame may precess with the liquid container about the gimbal axis. In one aspect, the means for urging the liquid to spin relative to the floating vessel comprises a mechanical motor; and a drive shaft rotated by the motor, the drive shaft being operatively connected to the container in order to frictionally impart rotational movement to liquid when liquid is placed within the liquid container.

In one embodiment, a method for stabilizing a floating vessel is provided. The method comprises the steps of providing a liquid container along the hull of the floating vessel, the liquid container having a valve for receiving liquid therein; moving the floating vessel to a desired location in a marine body; filling the liquid container with water from the marine body after the floating vessel has been moved to the desired location within the marine body; providing a motor in the hull of the floating vessel; and actuating the motor in order to cause rotational movement of the water relative to the hull of the floating vessel. The liquid container may be disposed within the hull of the floating vessel; and the motor comprise a mechanical motor having a drive shaft connected to the liquid container at a first end of the container. In this arrangement, the step of actuating the motor in order to cause rotational movement of the water relative to the hull of the floating vessel comprises rotating the liquid container relative to the hull of the floating vessel. The method may further comprise the steps of securing a first frame support member to the hull of the floating vessel, the first frame support member supporting the liquid container through a first bearing connection; and securing a second frame support member to the hull of the floating vessel, the second frame support member supporting the liquid container through a second opposing bearing connection; the first and second bearing connections providing a gimbal axis about which the liquid container may precess.

In another aspect, the present invention provides a floating vessel. The floating vessel comprises a hull; and a hydrogyroscope, comprising a liquid container disposed along the hull of the floating vessel, the liquid container having a rotational flow path therein, and a valve along the liquid container for receiving liquid into the rotational flow path of the liquid container. In this arrangement, the floating vessel may further comprise opposing frame support members securable to the hull of the floating vessel, the frame members providing bearing connections with the liquid container forming a gimbal axis about which the liquid container may precess.

In another aspect, the present invention provides an active gyroscopic system for stabilizing a vessel having a hull. The active gyroscopic system comprises a liquid container securable to the vessel, the liquid container having a gimbal shaft about which the liquid container rotates; a first mechanical motor; a drive shaft rotated by the motor, the drive shaft being operatively connected to the liquid container in order to frictionally impart rotational movement to liquid within the liquid container; opposing frame support members securable to the hull of the vessel, the frame members supporting the liquid container through the gimbal shaft; a first gear operably connected to the shaft of the liquid container; a motion sensing apparatus for sensing motion of the vessel; a second gear constructed and arranged to impart rotational movement to the liquid container through the first gear; a second mechanical motor for rotating the second gear; and a controller sensing motion of the gyroscope and sending a signal to the second mechanical motor to rotate the second gear in a desired direction, thereby forcing the liquid container to rotate about the gimbal shaft so as to stabilize the vessel. In one embodiment, the motion sensing apparatus comprises a gyroscope.

Description of Embodiments Shown in the Drawings

An illustrative apparatus for stabilizing a vessel is shown at 100 in FIG. 1. FIG. 1 presents a vessel stabilizing apparatus 100 within a vessel 10. The hull 12 of the vessel 10 is shown in cross-section. The vessel 10 in FIG. 1 is a ship-shaped vessel. However, it is understood that the vessel 10 may be of any shape. For example, a non-ship-shaped vessel such as an offshore working platform may utilize a vessel stabilizing apparatus 100.

The vessel stabilizing apparatus 100 operates as a "hydrogyroscope." The hydrogyroscope 100 includes a liquid container 110 disposed at a point along the hull 12 of the floating vessel 10. In the arrangement of FIG. 1, the liquid container 110 is placed within the hull 12 of the vessel 10. The liquid container 110 may be positioned anywhere within the hull 12 of the vessel 10. In one arrangement, the liquid container 110 will be placed at either the vessel roll axis for stabilizing against roll or the vessel pitch axis for stabilizing the vessel 10 against pitch.

The particular container 110 of FIG. 1 is configured to rotate about a rotational axis. The rotational axis of the container 110 is defined by a shaft 112. The illustrative container 110 is shaped as a cylinder. While a cylindrical arrangement is provided in FIGS. 1 and 2, it is understood that any symmetrical container for spinning a liquid mass may be employed.

The cylinder 110 of FIG. 1 has an internal chamber 115 for receiving liquid. At least one valve 116 is provided along the outer chamber wall 110' of the liquid container 110 for receiving liquid into the inner chamber 115. In the arrangement of FIG. 1, two separate valves 116', 116" are provided. The valves 116', 116" are disposed on opposite sides of the container 110 and are equidistantly positioned from the shaft 112 for balancing the liquid container 110 when it is rotated at high speeds. The valves 116', 116" serve as through-openings for moving liquid into or out of the annular chamber 115, allowing an operator to optionally fill the annular chamber 115 with ambient water after the floating vessel 10 has been located at a desired position in the marine environment. Where the marine environment is an ocean body, the operator may take advantage of the abundantly available seawater for filling the liquid container 110. In the view of FIG. 1, valve 116' represents an inlet valve, while valve 116" represents an offloading valve; however, the function of the valves 116', 116' may be interchangeable.

The vessel stabilizing apparatus 100 is permitted to precess about a gimbal axis. In the arrangement of FIG. 1, the liquid container 110 is connected to a gimbal frame 130, which in turn includes gimbal connections 122, which will be described further below. The gimbal frame 130 defines a sturdy structural frame that is connected to the liquid container 110. A connector 132 is seen in FIG. 1 providing fixed movement between the liquid container 110 and the gimbal frame 130 in the plane of the longitudinal axis of the vessel 10. The connector 132 resides along the rotational axis of the liquid container 110 at either end (or both ends) of the container 110. A bearing 134 is provided at the interface between the gimbal frame 130 and the connector 132. The bearing 134 allows the liquid container 110 to rotate relative to the gimbal frame 130 around an axis that is essentially vertical to the hull 12 of the vessel 10 when the hydrogyroscope is not precessing.

In the arrangement of FIG. 1, the gimbal bearing 134 is shown extending below the gimbal frame 130. In practice, the bearing 134 may reside within a recess (not shown) of the frame 130. Alternatively, the bearing 134 may be placed below the frame connector 132. The extending bearing 134 arrangement is provided for illustrative purposes.

As mentioned, the gimbal frame 130 provides a gimbal axis which permits the spinning liquid container 110 to precess. In the arrangement of FIG. 1, the gimbal frame 130 includes gimbal connections 122 secured between first and second frame support members 120. The gimbal connections 122 form the gimbal axis for the liquid container 110. Each of the gimbal connections 122 includes a bearing 124 that provides relative rotational movement between the gimbal frame 130 and the frame support members 120. The frame support members 120, in turn, are secured to the hull 12 of the vessel 10.

A means is provided for inducing rotational motion of the liquid within the inner chamber 115 of the container 110. In the embodiment of FIG. 1, the means is a motor M. The motor M is a mechanical motor, and may be either electrically powered, steam powered, hydraulically powered, or powered by a hydrocarbon fuel. In FIG. 1, the motor M is connected to the shaft 112 and mounted to the gimbal frame 130. This allows the liquid container 110 to precess along the major axis of the vessel 10.

Figure 2:
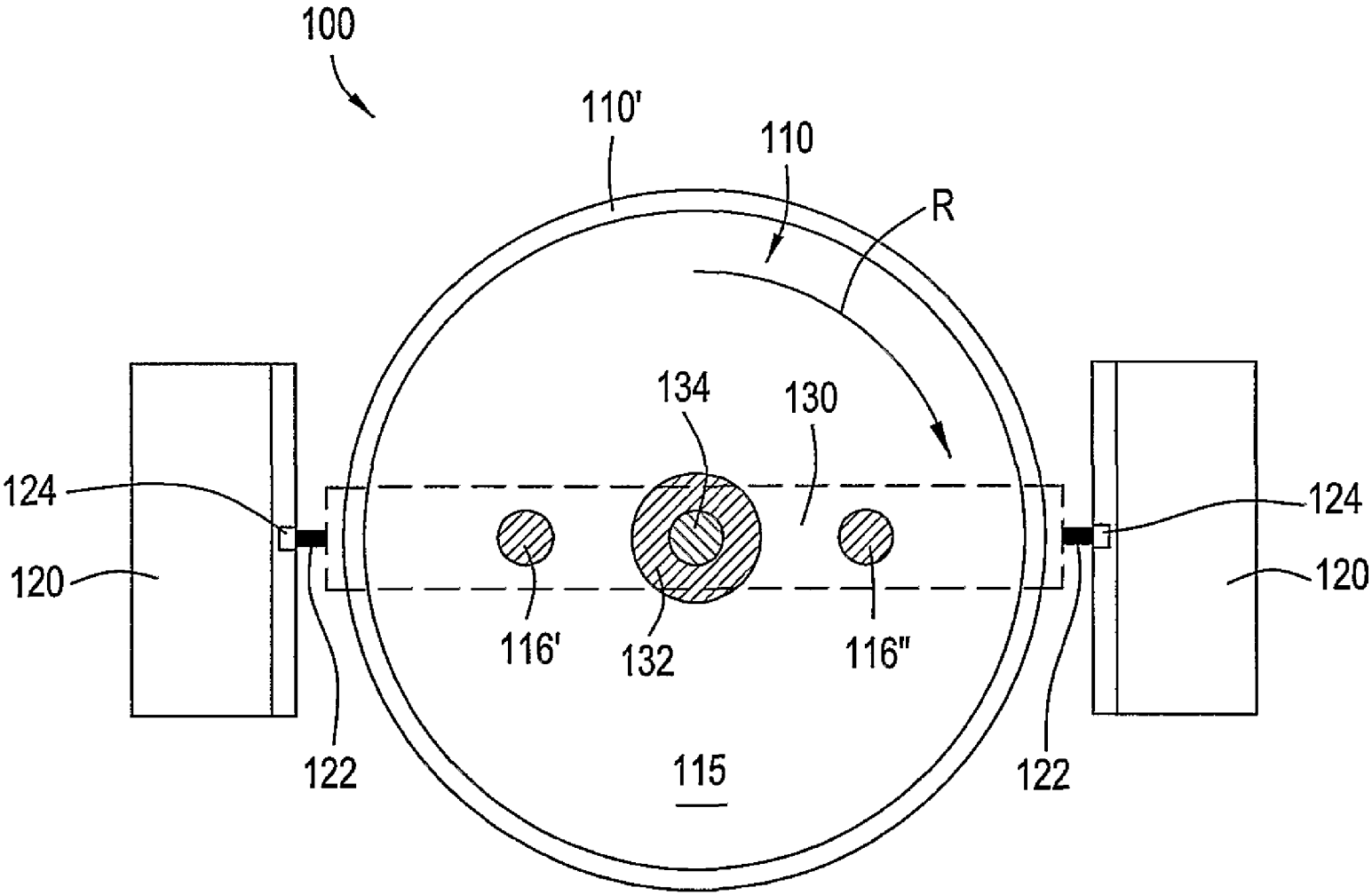
FIG. 2 is a plan view of the vessel stabilizing apparatus of FIG. 1. Arrow R denotes the direction of rotation for the liquid container.

FIG. 2 is a plan view of the vessel stabilizing apparatus 100 of FIG. 1. This figure is provided to demonstrate the relative rotational movement generated by the motor M (of FIG. 1) on the liquid container 110. Arrow R denotes the clockwise direction of rotation for the container 110. Of course, the direction of rotation may be either clockwise or counterclockwise. It can be more readily seen that the container 110 rotates relative to the gimbal frame 130 and the opposing frame support members 120. The bearing 134 is also visible through the gimbal frame 130.

In operation, the liquid container 110 serves as a hydrogyro rotor. Preferably, and as will be discussed more fully below, the liquid container 110 is filled with seawater after the vessel has been transported to a desired location offshore. The hydrogyro filled with seawater spins about the rotational axis using power from the motor M. The bearings 134 and connector 132 provide lateral support for the liquid container 110 relative to the gimbal frame 130, while allowing rotational movement of the liquid container 110. The liquid container 110, gimbal frame 130 and motor M are free to precess on the gimbal axis provided by the gimbal frame connectors 122. For example, when stabilizing against the rolling motion caused by a wave, the motor M would swing like a pendulum into and out of the page in the view of FIG. 1.

When the hydrogyro 100 senses torque translated from the ship hull 12 to the gimbal frame 130 and then to the gimbal axis 122, the liquid container 110 precesses about the gimbal axis 122.

Figure 3:
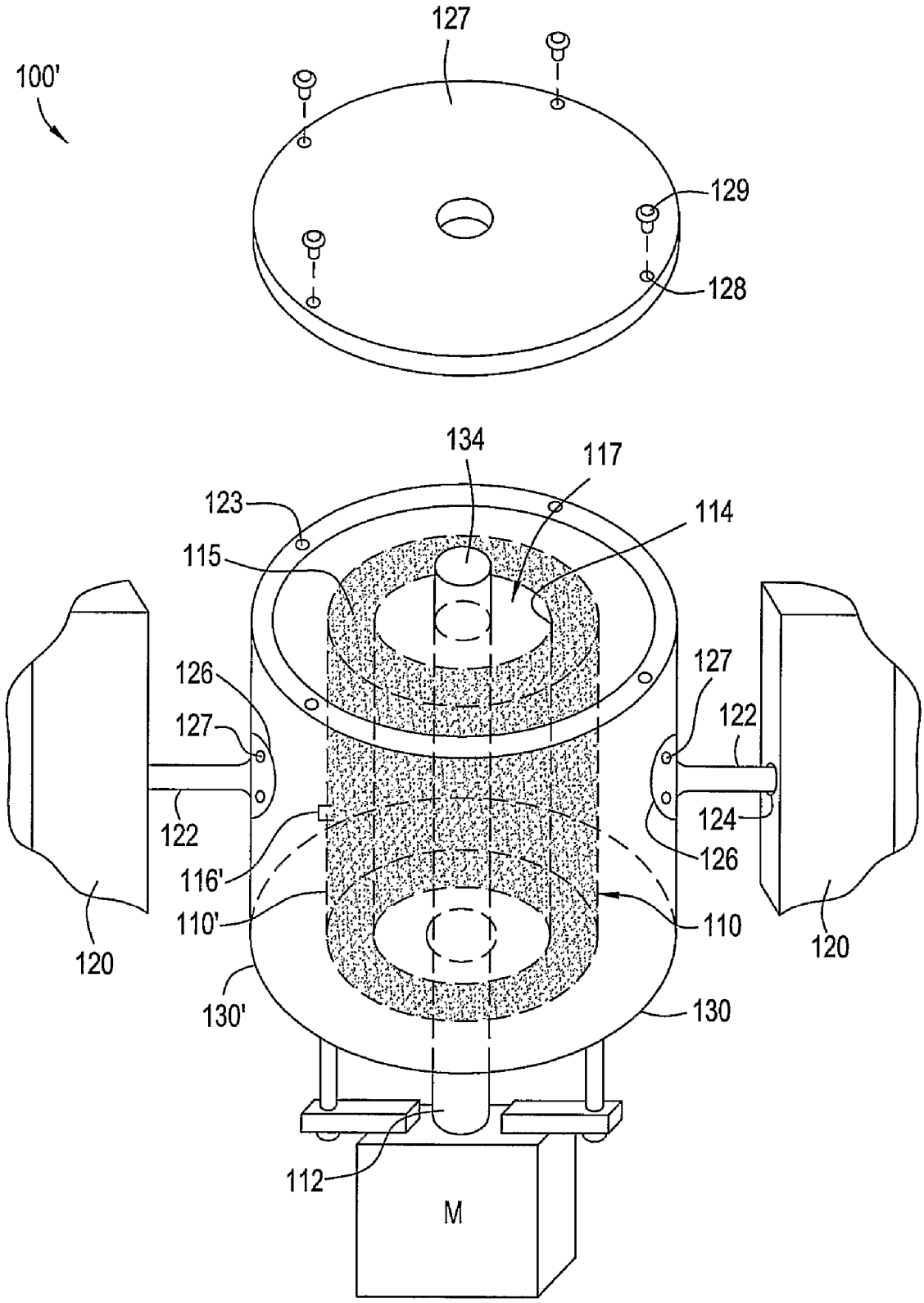
FIG. 3 provides an enlarged perspective view of a vessel stabilizing apparatus, in an alternate embodiment. In this embodiment, the gimbal frame itself is a cylindrical body.

FIG. 3 provides an enlarged perspective view of a vessel stabilizing apparatus 100', in an alternate embodiment. In this embodiment, the gimbal frame 130 is a cylindrical body. The cylindrical body configuration for the gimbal frame 130 provides a measure of safety in the event that the liquid chamber 115 loses integrity, particularly while rotating at a high speed. In addition, the cylindrical body configuration for the gimbal frame 130 provides a measure of safety in the event that the shaft 112 should break during rotation.

In the arrangement of FIG. 3, a connector arrangement can be seen between the gimbal frame 130 and the gimbal connections 122. The connector arrangement is shown at 126, and comprises a plate with bolts 127. A bearing 124 is provided between the gimbal connections 122 and the opposing frame members 120. It is understood that other connector arrangements may be utilized. Indeed, the present invention is not limited to the manner in which various mechanical connections are arranged, including the manner in which the shaft 112 is connected to the liquid container 110, the manner in which the gimbal frame 130 is connected to the liquid container 110, or the manner in which the gimbal frame 130 is connected to the frame supporting members 120.

The illustrative cylinder 110 of FIG. 3 employs an annular chamber ring 115 or circular ring configuration in which the liquid is retained. The optional chamber ring 115 increases the mean radius of rotation for the spinning liquid mass, thereby potentially increasing the stabilizing torque available to be applied to the vessel 10. A vacated inner region 117 is defined around the shaft 112. An inner chamber wall 114 is provided to separate the liquid chamber 115 from the vacated inner region 117. In the arrangement of FIG. 3, the inner chamber wall 114 is circular in profile, and is disposed concentrically within the outer chamber wall 110' to provide an annular flow path for liquid. However, it is preferred that the vacated inner region 117 be small or non-existent.

In the embodiments of FIGS. 1 and 3, rotational movement of the liquid within the liquid container 110 is induced by rotating the liquid container 110 about its rotational axis. Friction between the inner surface of the container 110 and the liquid contained therein urges the liquid to move in a rotational path relative to the hull 12 of the vessel 10. Rotational motion of the liquid container 110 is provided by actuating the mechanical motor M and connected drive shaft 112. As liquid travels along the inner surface of the outer chamber wall 110', angular momentum is created around the rotational axis of the container 110. This, in turn, creates precessional forces within the floating vessel 10. Because the frame supporting members 120 are secured to the hull 12 of the vessel 10, gyroscopic forces generated by the hydrogyroscope 100 are transmitted to the vessel 10.

As an alternative embodiment, rotational movement of liquid within the liquid container 110 may be induced by continuously circulating liquid into and through the liquid container 110. In such an arrangement, the motor defines one or more hydraulic pumps that pump liquid into the liquid container 110 at high velocity. An example of such an arrangement is seen in FIG. 4.

Figure 4:
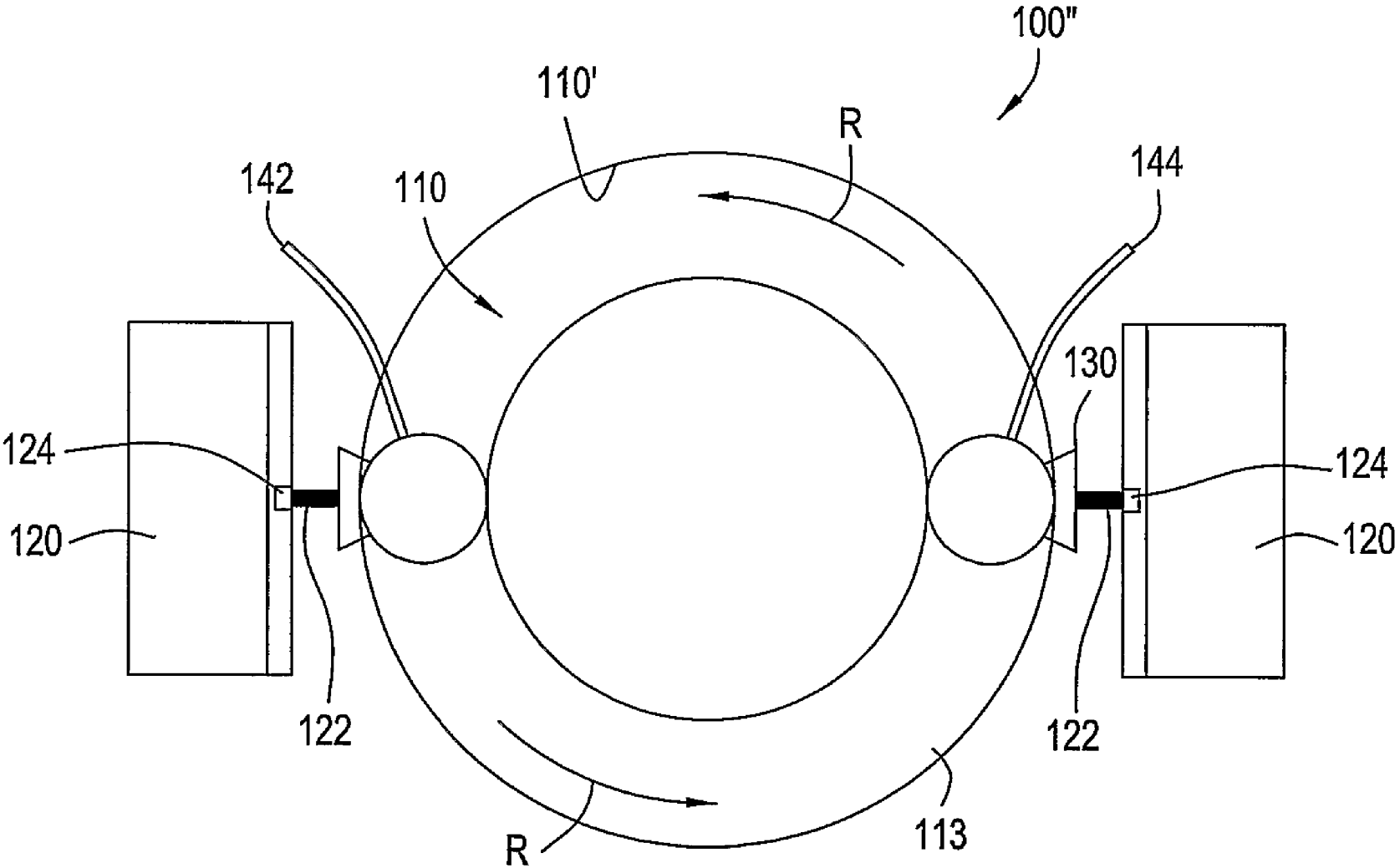
FIG. 4 presents a top view of a "hydrogyro" vessel stabilizing apparatus, in yet an additional alternate embodiment. In this arrangement, the liquid container defines an annular ring. The annular ring may be secured between frame support members within the hull of a vessel, or may be secured to the hull outside of the vessel.

FIG. 4 presents a top view of a "hydrogyro" vessel stabilizing apparatus 100" in an additional alternate embodiment. This alternate embodiment of a hydrogyro vessel stabilizer would preferably be used in non-ship-shaped vessels. Examples of such a vessel would be a SPAR, a CALM buoy, or even a workboat that includes a working platform. In this arrangement, the liquid container 110 defines an annular ring. The annular ring 110 is secured between frame support members 120 within the hull of a vessel, or may be secured to the hull outside of the vessel (not shown). In this latter arrangement, the frame members would be the hull of the vessel itself, and would reside within the inner diameter of the ring 110. In the arrangement of FIG. 4, frame support members 120 are represented within the hull of a vessel (not shown). In such an arrangement, a gimbal frame is not required separate from the liquid container 110. In this respect, a gimbal connection 122 is provided immediately between the liquid container 110 and each of the opposing frame support members 120. Each gimbal connection 122 includes a bearing 124 that allows the liquid container 110 to precess relative to the frame support members 120.

In the embodiment of FIG. 4, two separate pumps P are shown. The pumps P pump fluid, e.g., seawater, within the liquid container 110 in the direction shown by arrows R. Helically arranged fins (not shown) may optionally be disposed along an inner diameter of the container 110 to aid in moving seawater in an angular path. However, it is preferred that no obstructions be placed within the flow path of the liquid. It is understood that the arrangement of FIG. 4 preferably includes inlet and outlet lines in fluid communication with the pumps P. In FIG. 4, line 142 is provided as a fluid inlet line, while line 144 is provided as a fluid outlet line. The fluid source is the readily available ambient water. The lines 142, 144 allow draining and filling of the ring 110, and also provide a means of controlling any heat buildup that would result from continuously circulating a fluid through pumps P.

Once positioned at a desired location in a marine body, the vessel is moored using an anchor or mooring lines. Depending on the nature of the vessel, optional strakes and support trusses may be employed for the vessel in connection with the hydrogyroscope of FIG. 4. Such a vessel stabilizing apparatus allows pumping of ambient water inside the rotational tube along a larger radius, thereby creating high angular momentum forces. This permits useful gyroscopic forces to be applied to large working platforms offshore. The stabilizing torque provided by a gyroscope is directly proportional to the rotor mass, angular velocity of rotation, and angular velocity of precession, but it is also proportional to the square of the rotor radius. Therefore, the rotor radius has a much greater influence on the stabilizing torque than any other factor.

The following equations will shed additional light on the relationship of rotor radius, fluid mass velocity, and rate of precession. A spinning mass tends to remain within its plane of rotation unless acted upon by an external force. The formula for stabilizing torque provided by a gyroscope is:

$$\tau = I \times W_s \times W_p$$

where:

I is the moment of inertia which, for a cylinder, is defined by $I = \frac{1}{2} \text{mass} \times r^2$;

mass is the mass of the spinning cylinder (which may be the weight of the water plus the weight of the container);

r is the radius of the spinning cylinder;

$W_s$ is the angular velocity of the hydrogyroscope;

$W_p$ is the angular velocity of precession of the hydrogyroscope when subject to an excitation torque equal to the stabilizing torque; and When mass is in pounds (lbs) and radius is measured in feet (ft), I is given in foot-pounds-sec$^2$ (lb-ft-sec$^2$).

A May 1948 article in Westinghouse Engineer described an anti-roll gyroscope utilizing a solid spinning mass. The gyroscope was deployed in a 5,000 ton yacht. The article stated that the yacht required a stabilizing torque of 2,500,000 lb-ft for passenger comfort in rough seas. This information was used to estimate that 500 lb-ft stabilizing torque/ton vessel is needed. Based upon this value, and adapting this information to a spinning fluid mass, calculations can be made for the amount of stabilizing torque that a gyroscope should supply for passenger comfort, along with specifications for a hydrogyroscope to supply the necessary torque. A hydrogyroscope in accordance with the above-described embodiments can be designed with the following specifications:

| Mass of Vessel (in tons) | Stabilizing Torque Needed (in lb-ft) | No. of Gyros. | Ws (in rpm) | Wp (in deg/sec) | Radius of Cylinder (in ft) | Mass of Gyroscope (in lbs) | Thickness of Cylinder (in ft) |
|---|---|---|---|---|---|---|---|
| 5 | 2,500 | 1.0 | 2000 | 5 | 3 | 979 | 0.50 |
| 50 | 25,000 | 1.0 | 2000 | 5 | 4 | 5,506 | 1.71 |
| 100 | 50,000 | 1.0 | 2000 | 5 | 4 | 7,047 | 1.40 |
| 500 | 250,000 | 1.0 | 2000 | 5 | 7 | 17,977 | 1.82 |
| 1,000 | 500,000 | 1.0 | 2000 | 5 | 9 | 21,750 | 1.34 |
| 2,500 | 1,250,000 | 1.0 | 2000 | 5 | 10 | 44,044 | 2.19 |
| 5,000 | 2,500,000 | 1.0 | 2000 | 5 | 11 | 72,801 | 2.99 |
| 10,000 | 5,000,000 | 1.0 | 2000 | 5 | 12 | 122,345 | 4.22 |
| 25,000 | 12,500,000 | 1.0 | 2000 | 5 | 13 | 260,617 | 7.67 |
| 50,000 | 25,000,000 | 1.0 | 2000 | 5 | 14 | 449,432 | 11.40 |
| 100,000 | 50,000,000 | 1.0 | 2000 | 5 | 15 | 783,010 | 17.30 |
| 250,000 | 125,000,000 | 1.67 | 2000 | 5 | 16 | 1,029,759 | 20.00 |
| 500,000 | 250,000,000 | 2.62 | 2000 | 5 | 17 | 1,162,501 | 20.00 |
| 1,000,000 | 500,000,000 | 4.17 | 2000 | 5 | 18 | 1,303,288 | 20.00 |
| 5,000,000 | 2,500,000,000 | 13.7 | 2000 | 5 | 20 | 1,608,998 | 20.00 |
| 7,500,000 | 3,750,000,000 | 16.9 | 2000 | 5 | 21 | 1,773,920 | 20.00 |
| 10,000,000 | 5,000,000,000 | 18.7 | 2000 | 5 | 22 | 1,946,888 | 20.00 |

Based upon the foregoing description, those of ordinary skill in the art will appreciate that the hydraulic vessel stabilization apparatus may also employ a hydraulic rotor to act as an active ship gyrostabilizer. In one aspect, this would be used after the vessel has been moored.

Figure 5A:
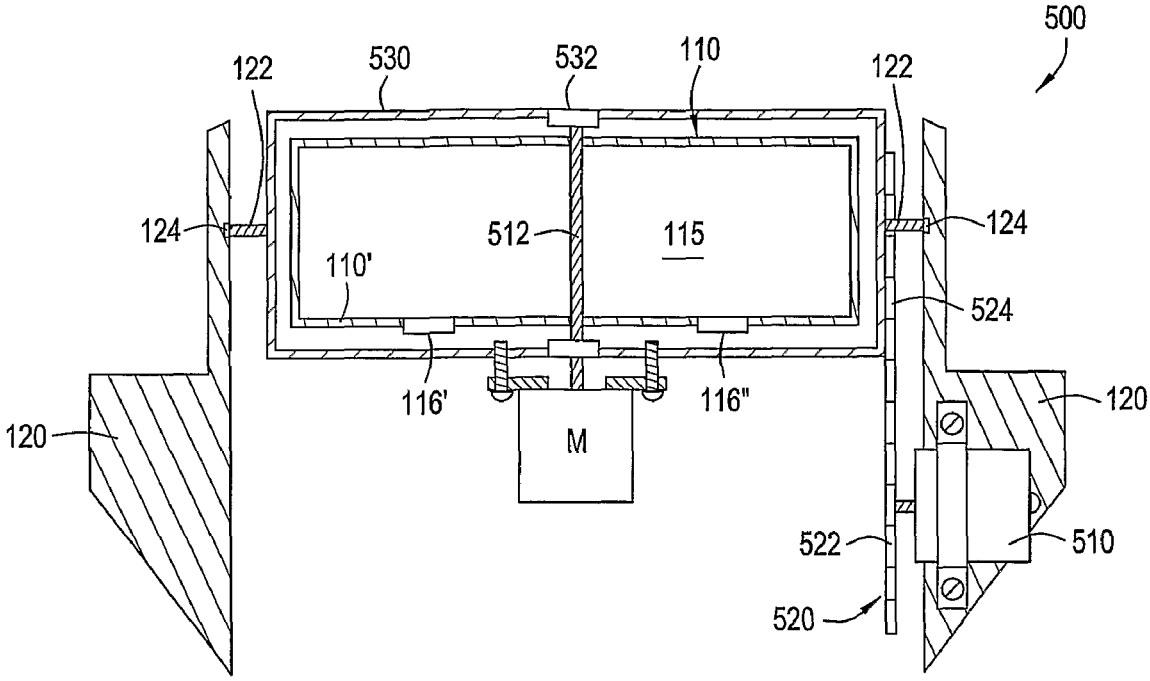
FIG. 5A presents yet an additional alternate embodiment of a hydrogyroscope. In this embodiment, the "hydrogyro" is part of an "active" system. A front view of the active gyroscopic system is shown.

FIG. 5A presents yet an additional alternate embodiment of a hydrogyroscope. A front view of the gyroscopic system 500 is shown. As with the passive system 100 of FIG. 1, a spinning liquid container 110 is provided. Rotational movement of the liquid container 110 is again provided by a motor M and a connected shaft 512. The liquid container 110 is again supported by a gimbal frame 530 and holds a fluid mass within a chamber 115. The chamber 115 provides an internal flow path in which fluid rotationally travels. The gimbal frame 530, in turn, is disposed between two opposing frame members 120, and suspended by a shaft 122 forming a gimbal axis. However, unlike the "passive" system of FIG. 1, in the embodiment of FIG. 5A the spinning liquid container 110 is provided as part of an "active" system.

Figure 5C:
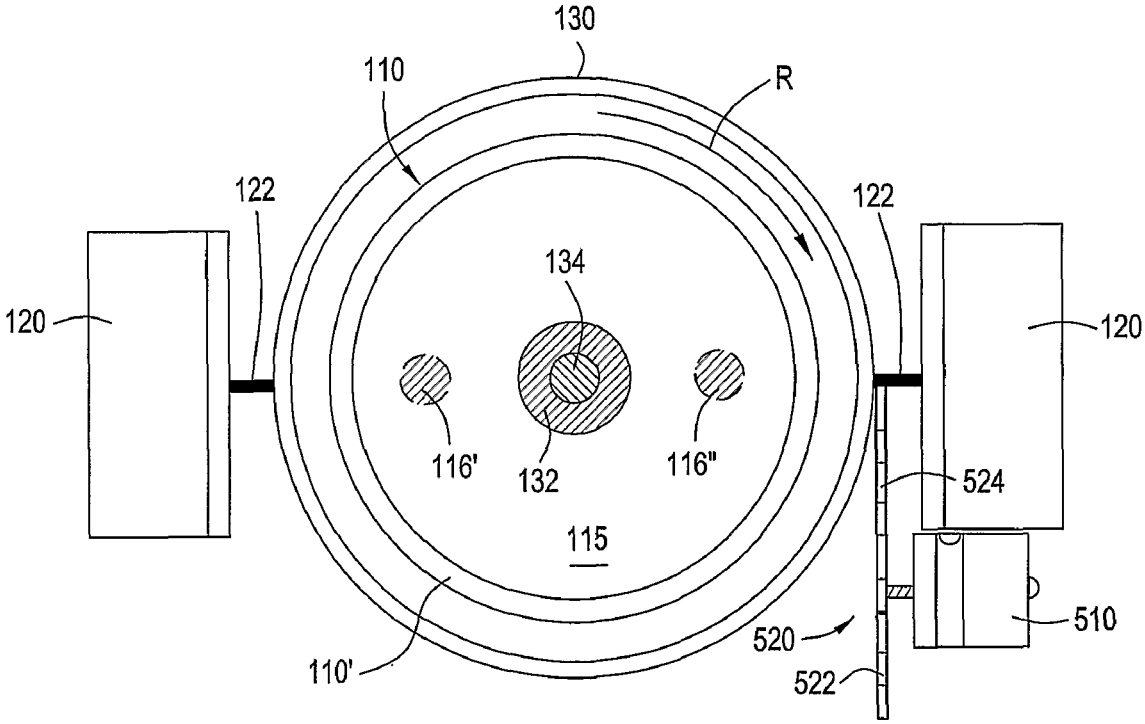
FIG. 5C is a plan view the gyroscopic system of FIG. 5A.
Figure 5B:
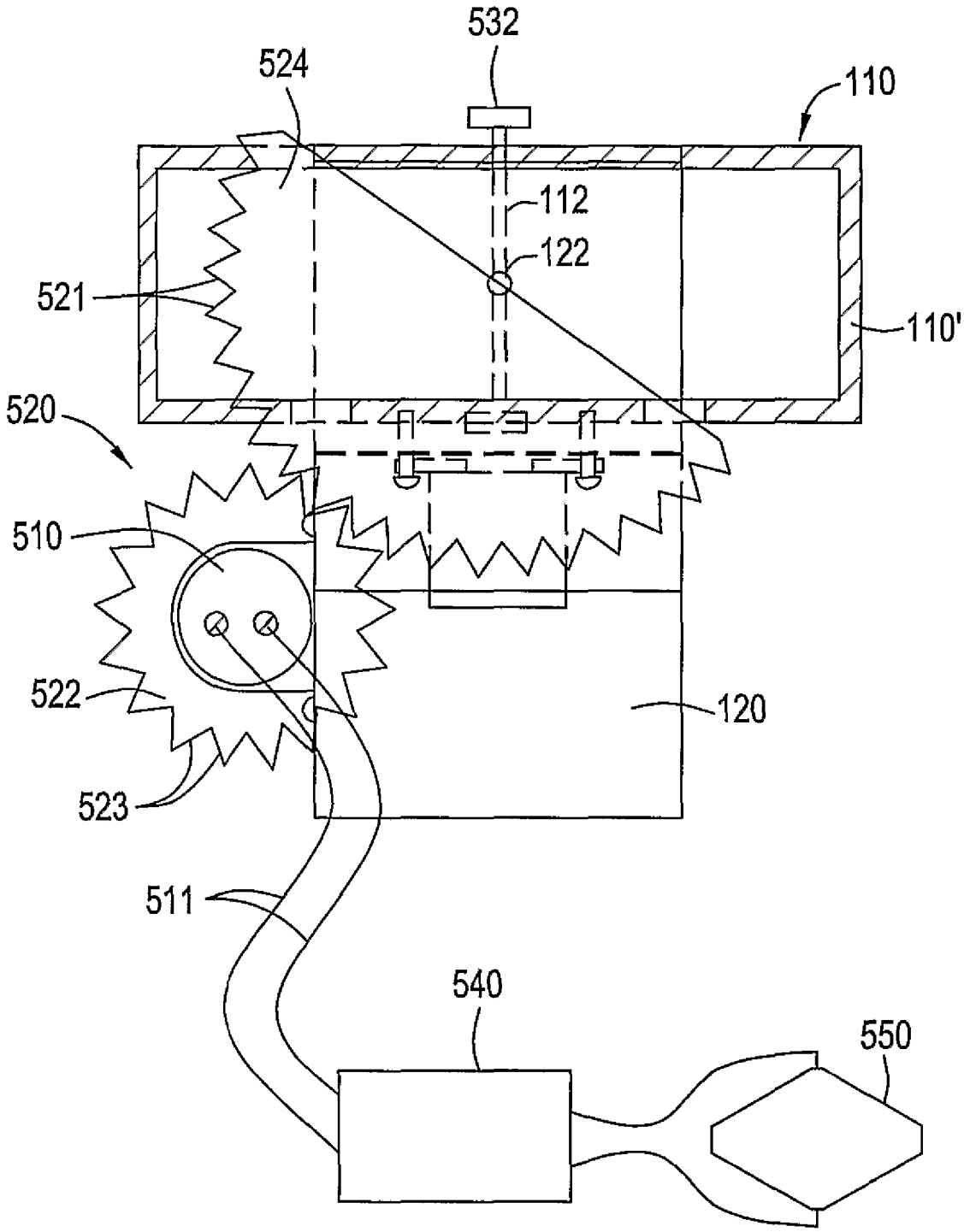
FIG. 5B is a side view of the gyroscopic system of FIG. 5A. Here, the gear system is more clearly seen. Finally.

The active system 500 of FIGS. 5A and 5B include a gear system 520. In the arrangement of FIG. 5A, the gear system 520 includes a first gear 524 connected to the gimbal axis 122. The first gear 524 turns in response to rotational mechanical force (such as by teeth) provided from a second gear 522. The second gear 522, in turn, is driven by a precession motor 510. Thus, movement by the precession motor 510 forces the gimbal frame 530 to turn, thereby creating precessional forces on the vessel (not shown in FIG. 5A).

FIG. 5B is a side view of the gyroscopic system 500 of FIG. 5A. Here, the gear system 520 is more clearly seen. Interlocking teeth 521, 523 from the first 524 and second 522 gears are seen, respectively.

The active gyroscopic system includes a separate, smaller gyroscope 550. The smaller gyroscope 550 is provided to sense rolling motion and/or pitch on the vessel. A controller 540 is provided that senses precessional forces generated by the smaller gyroscope 550. These precessional forces are then converted into electrical signals by the controller 540. The controller 540 is in electrical communication with the precession motor 510 by wires 511, and sends instructions to the precession motor 510 to turn the second gear 522 clockwise or counterclockwise, depending upon which precessional forces are to be applied by the spinning liquid container 110.

The smaller gyroscope 550 may be of any kind. However, it is preferred that it be a small gyroscope that weighs as little as a few ounces. The smaller "gyro" 550 is more sensitive to vessel movement, and permits highly responsive sensing by the controller 540. This allows the larger spinning "hydrogyro" container 110 to be manipulated by the gear system 520 quickly, enabling the gyroscopic system 500 to effectively counteract pitching or rolling motion, again depending upon the orientation of the frame members 120 as discussed above.

It is also noted that the use of an active gyroscopic system allows precessional forces to be generated with a smaller spinning liquid mass. In this respect, the second gear 522 can act on the first gear 524 to provide a higher angular velocity ($W_p$) for the liquid container 110 about the gimbal axis 122. Per the formula set forth and discussed above, an increase in $W_p$ permits a decrease in the moment of inertia (I) and/or angular velocity of the hydrogyroscope ($W_s$).

Finally, FIG. 5C is a top view the gyroscopic system 500 of FIG. 5A. Arrow R indicates the direction of rotation of the liquid container 110. Of course, the container 110 may be urged by the motor M to spin in either direction.

It can be seen from FIGS. 5A-5C that an active gyroscopic system for stabilizing a vessel is provided. In one aspect, the system 500 comprises a liquid container securable to a floating vessel. The liquid container 110 has a gimbal shaft 122 about which the liquid container 110 may rotate. The system 500 also includes a first mechanical motor M and a drive shaft 112 rotated by the motor M. The drive shaft is operatively connected to the liquid container 110 in order to frictionally impart rotational movement to liquid within the liquid container 110. Opposing frame support members 120 are provided. The frame support members 120 are securable to the hull of a vessel. The frame members support the liquid container 110 through the gimbal shaft 122. A first gear 524 is operably connected to the shaft 122.

Next, a motion sensing apparatus 550 is provided for sensing motion of the vessel. The motion sensing apparatus 550 may be a gyroscope, a pendulum or other device. Preferably, a small gyroscope is utilized as the sensing apparatus 550. A second gear 522 constructed and arranged to impart rotational movement to the liquid container 110 through the first gear 524 is provided. In addition, a second mechanical motor 510 for rotating the second gear 522 is provided. A controller 540 senses motion of the gyroscope 550, and sends a signal to the second mechanical motor 510 to rotate the second gear 522 in a desired direction. In this way, the liquid container 110 is forced to rotate about the gimbal shaft 122 so as to stabilize the vessel.

Referring back to the arrangement of FIG. 1, the frame support members 120 are secured to the hull 12 of the vessel 10 at an orientation that is orthogonal to the length (or major axis) of the vessel 10. This provides stabilization of the vessel 10 as to roll. If the operator desires to stabilize the vessel 10 as to pitch, the frame support members 120 are secured to the hull 12 of the vessel 10 at an orientation that is parallel to the length of the vessel 10. In one arrangement, a pair of vessel stabilizing apparatuses 110 is provided in the hull 12 of the vessel 10, with one being positioned to stabilize the vessel as to pitch forces, and the other being positioned to stabilize the vessel as to roll forces. In another arrangement, a single hydrogyroscope may be employed, with the hydrogyroscope being rotatable within the hull of the vessel. For example, the opposing frame support members could be placed on a circular track and given freedom to move in a circular plane. In this way, a single hydrogyroscope (whether active or passive) may be employed to stabilize the vessel both as to pitch forces and as to roll forces.

A method is also provided for stabilizing a floating vessel. In one embodiment, a liquid container is secured to the hull of a floating vessel. The liquid container may be as described above, and receives liquid therein. The liquid container is secured to the hull of the floating vessel. The floating vessel is moved to a desired location in a marine body, such as the ocean. The liquid container is filled with liquid such as sea water. Preferably, this occurs after the vessel has been moved to the desired location and moored. A motor is provided to actuate rotational movement of the liquid within the liquid container. The motor may be a mechanical motor as described above, causing rotational movement of the liquid container relative to the hull of the floating vessel. Alternatively, the motor may be a hydraulic motor, or pump, that continuously circulates liquid within the liquid container along a rotational flow path.

The present inventions provide improvements over known active and passive gyroscope stabilizer systems because, among other improvements, they incorporate a water-filled rotor (hydrogyroscope) or spinning liquid mass rather than a solid metal mass. One benefit of a spinning liquid mass is that the water can be offloaded when the stabilizing force is not needed. For example, when a vessel is moored and rolling motions cause a concern for passenger safety or operational integrity, the hydrogyroscope can be filled with water and put into operation. When the vessel is in transit and the stabilization provided by the hydrogyroscope is not needed, the water can be discharged, thereby reducing the vessel mass and conserving energy and fuel.

The hydrogyroscope has application to all floating vessels and structures that require stability. A large hydrogyroscope will stabilize a very large vessel, while a smaller hydrogyroscope can stabilize a small pleasure craft, racing boat or rescue boat. For example, a hydrogyro mounted with the gimbal axis parallel to the major axis of the vessel would act to counteract any sudden change in vessel attitude caused by choppy water and thereby decrease the possibility of a boat becoming airborne.

What is claimed is:

1. A vessel stabilizing apparatus, comprising:

a circular tube liquid container securable to a floating vessel, the floating vessel suitable for use in a marine body;

a first valve on the liquid container suitable for receiving a volume of water from the marine body into the liquid container;

means for urging the liquid within the liquid container to spin relative to the floating vessel in order to stabilize the floating vessel within the marine body; and opposing frame support members securable to the hull of a floating vessel, the frame members providing bearing connections with the liquid container forming a gimbal axis about which the liquid container may precess.

2. The vessel stabilizing apparatus of claim 1, further comprising a gimbal frame for supporting the liquid container, the gimbal frame having at least one connector connected to the liquid container along an axis of rotation of the liquid container;

and wherein the bearing connections of the opposing frame support members are connected to the gimbal frame so that the gimbal frame may precess with the liquid container about the gimbal axis.

3. The vessel stabilizing apparatus of claim 1, wherein the means for urging the liquid to spin relative to the floating vessel comprises:

a mechanical motor; and a drive shaft rotated by the motor, the drive shaft being operatively connected to the container in order to frictionally impart rotational movement to liquid when liquid is placed within the liquid container.

4. The vessel stabilizing apparatus of claim 1, further comprising:

a second valve on the liquid container for offloading the volume of water from the liquid container.

5. The vessel stabilizing apparatus of claim 1, wherein the liquid container defines a circular ring disposed within the hull of the vessel.

6. The vessel stabilizing apparatus of claim 1, wherein the means for urging the liquid to spin relative to the floating vessel comprises at least one pump for continuously circulating liquid in the liquid container.

7. A vessel stabilizing apparatus, comprising:

a liquid container having a rotational flow path therein, the liquid container securable to a floating vessel;

a motor suitable for causing rotational movement of the liquid container relative to a hull of the floating vessel, thereby causing rotational movement of a liquid within the liquid container;

a first frame support member disposed on the hull of the vessel for supporting the liquid container through a first bearing connection;

a second opposing frame support member disposed on the hull of the vessel for supporting the liquid container through a second bearing connection, the bearing connections providing a gimbal axis about which the liquid container may precess.

8. The vessel stabilizing apparatus of claim 7, further comprising:

a valve along the liquid container for receiving liquid into the rotational flow path of the liquid container.

9. The vessel stabilizing apparatus of claim 8:

further comprising a gimbal frame for supporting the liquid container, the gimbal frame having at least one connector connected to the liquid container in an axis of rotation of the liquid container;

and wherein the first and second bearing connections of the frame support members are connected to the gimbal frame so that the gimbal frame may precess with the liquid container.

10. The vessel stabilizing apparatus of claim 7, wherein:

the motor defines a mechanical motor that imparts rotation to a drive shaft; and the drive shaft is operatively connected to the liquid container in order to impart rotational movement to the liquid container.

11. A method for stabilizing a floating vessel, comprising the steps of:

providing a floating vessel with a liquid container and a motor along the hull of the floating vessel, the liquid container having a valve for receiving liquid therein, the liquid container having a first frame support member secured to the hull of the floating vessel, the first frame support member supporting the liquid container through a first bearing connection, and the liquid container having a second frame support member secured to the hull of the floating vessel, the second frame support member supporting the liquid container through a second opposing bearing connection, the first and second bearing connections providing a gimbal axis about which the liquid container may precess;

moving the floating vessel to a desired location in a marine body while water is discharged from the liquid container;

filling the liquid container with water from the marine body after the floating vessel has been moved to the desired location within the marine body; and actuating the motor in order to cause rotational movement of the water relative to the hull of the floating vessel.

12. The method of claim 11, wherein:

the liquid container is disposed within the hull of the floating vessel;

the motor comprises a mechanical motor having a drive shaft connected to the liquid container at a first end of the container; and the step of actuating the motor in order to cause rotational movement of the water relative to the hull of the floating vessel comprises rotating the liquid container relative to the hull of the floating vessel.

13. The method of claim 11, wherein:

the first and second bearing connections of the frame support members are connected to the liquid container through a gimbal frame, the gimbal frame comprising at least one connector connected to the liquid container in an axis of rotation of the liquid container to support the liquid container and to precess with the liquid container.

14. The method of claim 13, further comprising the step of:

removing water from the liquid container.

15. The method of claim 14, further comprising the step of:

moving the floating vessel to a new location after the liquid container has been substantially emptied of water.

16. The method of claim 11, wherein:

the liquid container provides a circular flow path;

the motor comprises a pump for continuously circulating liquid in the liquid container through the valve; and the step of actuating the motor in order to cause rotational movement of the water relative to the hull of the floating vessel comprises pumping liquid into the annular ring.

17. The method of claim 16, wherein:

the liquid container defines an annular ring disposed external to the hull of the floating vessel.

18. The method of claim 11, wherein the floating vessel is a floating production, storage and offloading vessel ("FPSO").

19. The method of claim 11, wherein the floating vessel is selected from the group comprising a pleasure boat, an offshore rescue craft, a CALM buoy, a racing boat, a SPAR, an oceanographic survey vessel, and a seismic vessel.

20. The method of claim 11, wherein the floating vessel is a tanker.

21. The method of claim 20, wherein the tanker is an LNG tanker.

22. The method of claim 11, wherein the floating vessel is an offshore workboat.

23. The method of claim 22, wherein the offshore workboat is a drillship.

24. A floating vessel, comprising:

a hull; and a hydrogyroscope, comprising:

a circular tube liquid container disposed along the hull of the floating vessel, the liquid container having a rotational flow path therein;

opposing frame support members securable to the hull of the floating vessel, the frame members providing bearing connections with the liquid container forming a gimbal axis about which the liquid container may precess; and a valve along the liquid container for receiving liquid into the rotational flow path of the liquid container.

25. The floating vessel of claim 24, wherein the gimbal axis is disposed orthogonal to a major axis of the vessel.

26. The floating vessel of claim 24, wherein the gimbal axis is disposed parallel to a major axis of the vessel.

27. The floating vessel of claim 24, wherein the floating vessel comprises a pair of hydrogyroscopes in the hull of the vessel, with one hydrogyroscope being positioned to stabilize the vessel as to pitch forces, and the other hydrogyroscope being positioned to stabilize the vessel as to roll forces.

28. An active gyroscopic system for stabilizing a vessel, the vessel having a hull, the gyroscopic system comprising:

a liquid container securable to the vessel, the liquid container having a gimbal shaft about which the liquid container rotates;

a first mechanical motor;

a drive shaft rotated by the motor, the drive shaft being operatively connected to the liquid container in order to frictionally impart rotational movement to liquid within the liquid container;

opposing frame support members securable to the hull of the vessel, the frame members supporting the liquid container through the gimbal shaft;

a first gear operably connected to the shaft of the liquid container;

a motion sensing apparatus for sensing motion of the vessel;

a second gear constructed and arranged to impart rotational movement to the liquid container through the first gear;

a second mechanical motor for rotating the second gear; and a controller sensing motion of the gyroscope and sending a signal to the second mechanical motor to rotate the second gear in a desired direction, thereby forcing the liquid container to rotate about the gimbal shaft so as to stabilize the vessel.

29. The active gyroscopic system of claim 28, wherein the motion sensing apparatus comprises a gyroscope.

30. A vessel stabilizing apparatus, comprising:

a circular tube liquid container securable to a floating vessel, the floating vessel suitable for use in a marine body;

a first valve on the liquid container suitable for receiving a volume of ambient water from the marine body into the liquid container;

a movement device for urging the liquid within the liquid container to spin relative to the floating vessel in order to stabilize the floating vessel within the marine body; and opposing frame support members securable to the hull of a floating vessel, the frame members providing bearing connections with the liquid container forming a gimbal axis about which the liquid container may precess.

31. The vessel stabilizing apparatus of claim 30, further comprising a gimbal frame for supporting the liquid container, the gimbal frame having at least one connector connected to the liquid container along an axis of rotation of the liquid container;

and wherein the bearing connections of the opposing frame support members are connected to the gimbal frame so that the gimbal frame may precess with the liquid container about the gimbal axis.

32. The vessel stabilizing apparatus of claim 31, wherein the opposing frame support members are permitted to rotate within a circular plane within the hull of the vessel, whereby the vessel stabilizing apparatus may act to stabilize the vessel both as to pitch forces and as to roll forces.

33. The vessel stabilizing apparatus of claim 30, wherein the movement device comprises:

a mechanical motor; and a drive shaft rotated by the motor, the drive shaft being operatively connected to the container in order to frictionally impart rotational movement to liquid when liquid is placed within the liquid container.

34. The vessel stabilizing apparatus of claim 30, wherein the liquid container defines a circular ring disposed within the hull of the vessel; and the movement device comprises at least one pump for continuously circulating liquid in the liquid container.

* * * * *